US006201354B1

(12) United States Patent
Kokubo

(10) Patent No.: US 6,201,354 B1
(45) Date of Patent: Mar. 13, 2001

(54) DEVICE FOR CONTROLLING LIGHT SOURCES

(75) Inventor: Hideyuki Kokubo, Saitama (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 09/451,781

(22) Filed: Dec. 1, 1999

(30) Foreign Application Priority Data

Dec. 1, 1998 (JP) ..... 10-341251

(51) Int. Cl.[7] ..... G05F 1/00

(52) U.S. Cl. ..... 315/194; 315/291; 315/324; 315/307

(58) Field of Search ..... 315/194, 291, 315/324, 209 R, 307; 358/296; 347/246, 247, 234, 237; 360/59, 67, 61

(56) References Cited

U.S. PATENT DOCUMENTS 5,661,612 * 8/1997 Hasegawa et al. ..... 360/59
5,673,115 * 9/1997 Arimoto ..... 358/296
5,774,166 * 6/1998 Kazuyuki ..... 347/248
5,821,700 * 10/1998 Malvaso ..... 315/291

* cited by examiner

*Primary Examiner*—Haissa Philogene
(74) *Attorney, Agent, or Firm*—Sughrue, Mion, Zinn, Macpeak & Seas, PLLC

(57) ABSTRACT

An optical fixing unit for yellow fixes a yellow thermosensitive coloring layer of a color thermosensitive recording paper. This fixation is carried out by simultaneously driving two ultraviolet lamps for yellow. The respective ultraviolet lamps are repeatedly energized since switching transistors corresponding thereto are repeatedly turned on and off based on switching signals. The switching signals respectively inputted to the switching transistors have phases shifted by 180° with each other so that emission phases of the ultraviolet lamps are shifted. As a result, a peak value of a total current flowing in the ultraviolet lamps is reduced, and a change thereof is kept in a narrow range.

7 Claims, 4 Drawing Sheets

DEVICE FOR CONTROLLING LIGHT SOURCES

BACKGROUND OF THE INVENTION

1. Field of the Invention

The present invention relates to a device for controlling light sources which are used in an optical fixing unit of a thermal printer, or used for lighting in a copying machine, a scanner and so forth, or used for optical recording.

2. Description of the Related Art

For example, a color thermal printer uses a color thermosensitive recording paper in which cyan, magenta and yellow thermosensitive coloring layers are formed on a support member in order. In such a printer, the recording paper is pressed and heated by a thermal head to record a color image in the thermosensitive coloring layers. The yellow and magenta thermosensitive coloring layers are respectively fixed, just after recording, by applying ultraviolet rays having a peculiar wave-length range relative to each coloring layer. The ultraviolet rays are emitted from an optical fixing unit, a light source of which is an ultraviolet lamp being a kind of a fluorescent lamp. As for a copying machine, a scanner or the like, an original is illuminated by a fluorescent lamp and so forth being as a light source. In such machines, obtained transmission light or reflection light is photoelectrically converted to store an image in a recording medium as image data.

Some of the above-mentioned optical fixing units and scanners have a plurality of light sources for purposes of increasing an application amount of the ultraviolet rays and a light amount of the illumination. These light sources simultaneously apply the ultraviolet rays or simultaneously illuminate the original. For example, in a color thermal printer, ultraviolet lamps for applying the ultraviolet rays having an identical wave length are arranged in a conveying direction of the color thermosensitive recording paper so as to constitute a single optical fixing unit. The respective ultraviolet lamps are energized by letting a current flow. On the other hand, there is a color thermal printer of a three-head one-pass system in which images of the respective colors are recorded by three thermal heads. In such a printer, positions for applying the ultraviolet rays to a color thermosensitive recording paper are different. However, the respective ultraviolet lamps for fixing the yellow and magenta thermosensitive coloring layers are simultaneously energized by letting the current flow.

By the way, when the currents simultaneously flow in a plurality of the light sources, for example N (integer) fluorescent lamps, the N-times currents flow in comparison with a case in that a single light source is employed. Thus, it is necessary to increase a rated power of a power circuit for supplying the power to the light sources. This causes a problem in that the power circuit needs to be enlarged. Meanwhile, when an inverter circuit or the like is used for letting the intermittent current flow and for repeatedly energizing the fluorescent lamps, peaks and troughs of the current flowing in the respective fluorescent lamps overlap with each other. In other words, a range of a load change becomes wide on the power circuit so that a voltage outputted from the power circuit is made unstable. Due to this, sometimes, a bad effect is given to the other operation in which the power circuit is used in common.

SUMMARY OF THE INVENTION

In view of the foregoing, it is a primary object of the present invention to provide a device for controlling light sources in which a size of a power circuit may be reduced when a plurality of the light sources are used for recording, fixing and/or illuminating.

It is a second object of the present invention to provide a device for controlling light sources in which an output voltage of a power circuit is adapted to be stable when a plurality of the light sources are used for recording, fixing and/or illuminating.

In order to achieve the above and other objects, the device for controlling the light sources comprises light-source driving elements provided for the respective light sources. The light source is energized in accordance with activation of the light-source driving element.

In a preferred embodiment, two ultraviolet lamps are used as the light sources, and two switching transistors are used as the light-source driving elements. Each of the ultraviolet lamps is connected to the corresponding switching transistor. The ultraviolet lamp is energized when the switching transistor is turned on. In this condition, the switching transistor is repeatedly turned on and off so that the ultraviolet lamp is repeatedly energized to intermittently emit the light.

On the other hand, the switching transistors are connected to a signal output circuit comprising a signal generation circuit and a phase delay circuit. The signal generation circuit generates a switching signal for repeatedly turning on and off the switching transistor, and the phase delay circuit is connected to the signal generation circuit in order to delay a phase of the switching signal.

The switching signal from the signal generation circuit is directly inputted to one of the switching transistors, and is inputted to the other of the switching transistors via the delay circuit. Thus, the phases of the switching signals inputted to the switching transistors are shifted. As a result, emission phases of the ultraviolet lamps are shifted so that a peak value of a total current flowing in the ultraviolet lamps is reduced, and a change thereof is kept in a narrow range.

BRIEF DESCRIPTION OF THE DRAWINGS

The above objects and advantages of the present invention will become apparent from the following detailed description of the preferred embodiments of the invention when read in conjunction with the accompanying drawings, in which.

DETAILED DESCRIPTION OF THE PREFERRED EMBODIMENT (S)

Figure 2:
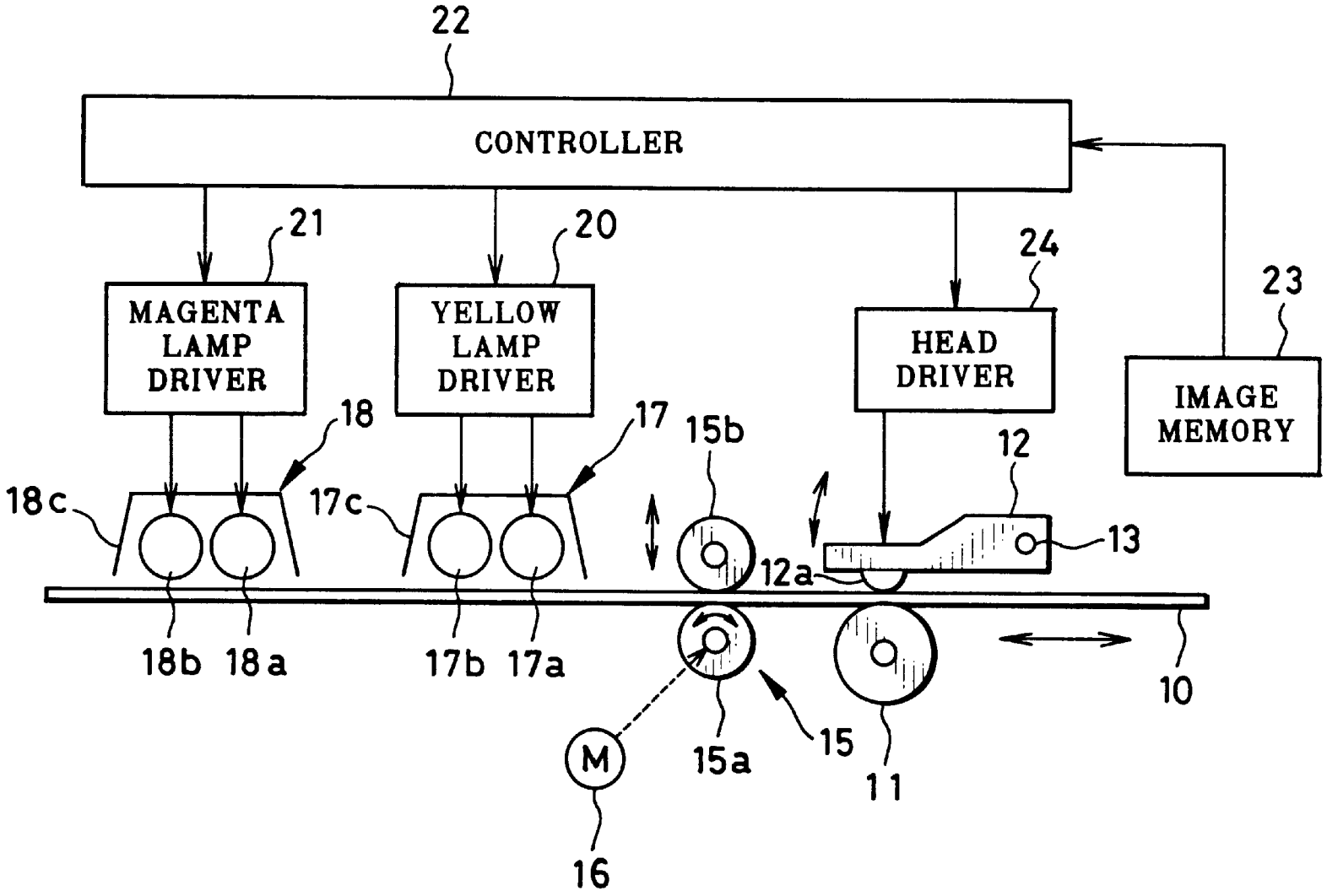
FIG. 2 is a block diagram schematically showing a thermal printer according to the present invention.

FIG. 2 schematically shows a color thermal printer according to the present invention. A rotatable platen roller 11 is disposed on the way of a conveyance passage for conveying a color thermosensitive recording paper 10. Moreover, a thermal head 12 is disposed at a position opposite to the platen roller 11. The thermal head 12 comprises a heating element array 12*a* formed on the bottom thereof. The heating element array 12*a* has many heating elements aligned in a main-scanning direction (a width direction of the recording paper) being perpendicular to a conveyance direction of the recording paper 10. The thermal head 12 is rotatable around a shaft 13 to swing between a printing position where the heating element array 12*a* is pressed against the recording paper 10 placed on the platen roller 11, and an evacuation position where the heating element array 12*a* is separated from the platen roller 11.

As well known, the color thermosensitive recording paper 10 comprises cyan, magenta and yellow thermosensitive coloring layers which are formed on a support member in order. The deeper coloring layer needs higher thermal energy to be colored. As to this recording paper 10, the lowest thermal energy is required for the yellow thermosensitive coloring layer and the highest thermal energy is required for the cyan thermosensitive coloring layer.

The thermal energy includes bias thermal energy and gradation thermal energy. The bias thermal energy is applied just before the coloring layer is colored. The gradation thermal energy is applied for coloring each layer at desired density. The bias thermal energy is constant for the respective coloring layers. However, the gradation thermal energy changes in accordance with the coloring density of a recorded pixel, or a gradation level, on the basis of a characteristic curve of the recorded coloring layer. The coloring density becomes higher as the gradation thermal energy increases. Meanwhile, the yellow thermosensitive coloring layer has optical fixing properties relative to the near ultraviolet rays of 420 nm. By applying this near ultraviolet rays, the yellow thermosensitive coloring layer loses its coloring ability. Similarly, the magenta thermosensitive coloring layer loses its coloring ability by applying the ultraviolet rays of 365 nm.

The thermal head 12 colors and records a single color image one line by one line with the heating element array 12*a* while the recording paper 10 is conveyed from an upstream side (right side in FIG. 2) to a downstream side (left side in FIG. 2). The recording paper 10 is reciprocated by three times. During this reciprocation, a color image is colored and recorded in a three-color frame-sequential manner. At this time, yellow, magenta and cyan are colored in this order.

A conveyor roller pair 15 is disposed at a downstream side of the thermal head 12. This roller pair L5 comprises a capstan roller 15*a* driven by a pulse motor 16, and a pinch roller 15*b* rotated in accordance with the conveyance of the recording paper 10. The pinch roller 15*b* is movable between a nipping position and a non-nipping position. When the pinch roller 15*b* is set at the nipping position, the recording paper 10 is nipped by the capstan roller 15*a* and the pinch roller 15*b*. When the pinch roller 15*b* is set at the non-nipping position, the pinch roller 15*b* is separated from the recording paper 10. The capstan roller 15*a* of the roller pair 15 is rotated forward and in reverse by the pulse motor 16. Owing to the rotation of the roller pair 15, the recording paper 10 is reciprocated along the conveyance passage.

A yellow fixing unit 17 and a magenta fixing unit 18 are disposed at a downstream side of the conveyor roller pair 15. The yellow fixing unit 17 comprises first and second ultraviolet lamps 17*a*, 17*b* for yellow, and a reflector 17*c*. The first and second ultraviolet lamps 17*a* and 17*b* are arranged in the conveying direction of the recording paper 10, and the back thereof is covered with the reflector 17*c*. The magenta fixing unit 18 comprises first and second ultraviolet lamps 18*a*, 18*b* for magenta, and a reflector 18*c*. The first and second ultraviolet lamps 18*a* and 18*b* are arranged similarly to the ultraviolet lamps of the yellow fixing unit 17, and the back thereof is covered with the reflector 18*c*.

The respective ultraviolet lamps 17*a* and 17*b* for yellow are repeatedly energized to emit the near ultraviolet rays whose luminous peak is 420 nm (hereinafter yellow ultraviolet rays) while a yellow image is recorded with the thermal head 12. In virtue of this, the yellow ultraviolet rays are applied to a portion of the recording paper 10 where the yellow image is colored and recorded. Thus, the yellow thermosensitive coloring layer loses its coloring ability so that the yellow image is fixed.

On the other hand, the respective ultraviolet lamps 18*a* and 18*b* for magenta are repeatedly energized to emit the ultraviolet rays whose luminous peak is 365 nm (hereinafter magenta ultraviolet rays) while a magenta image is recorded. Due to this, the magenta ultraviolet rays are applied to a portion of the recording paper 10 where the magenta image is colored and recorded. Thus, the magenta thermosensitive coloring layer loses its coloring ability so that the magenta image is fixed.

The yellow ultraviolet lamps 17*a*, 17*b* and the magenta ultraviolet lamps 18*a*, 18*b* are respectively driven by a yellow lamp driver 20 and a magenta lamp driver 21. With respect to the ultraviolet lamps 17*a*, 17*b*, 18*a* and 18*b*, similarly to a conventional fluorescent lamp, a fluorescent material included in a lamp tube emits the Light when an electric discharge is performed between a pair of filaments.

In this embodiment, the yellow and magenta ultraviolet rays are adapted to be applied to the recording paper 10 by a prescribed amount without slowing a conveyance speed of the recording paper 10. In view of this, the ultraviolet lamps of the fixing units 17 and 18 are arranged in the conveying direction of the recording paper 10. However, when a wide recording paper is used and an application area of the ultraviolet rays is wide, a longitudinal direction of the ultraviolet lamp is adapted to coincide with a width direction of the recording paper and the ultraviolet lamps are arranged so as to be aligned in this width direction.

A controller 22 controls each section of the color thermal printer. In an image memory 23, are stored yellow, magenta, and cyan image data of an image recorded on the color thermosensitive recording paper 10. At the time of recording, the controller 22 reads outs the image data from the image memory 23 one line by one line. For example, when the yellow image is recorded, the yellow image data is read out from the image memory 23 to be sent to a head driver 24.

The head driver 24 converts the image data inputted one line by one line to drive data. Base on the drive data, the respective heating elements of the heating element array 12*a* are driven. The respective heating elements generate the thermal energy for coloring the recording paper 10 in accordance with the corresponding image data.

Figure 1:
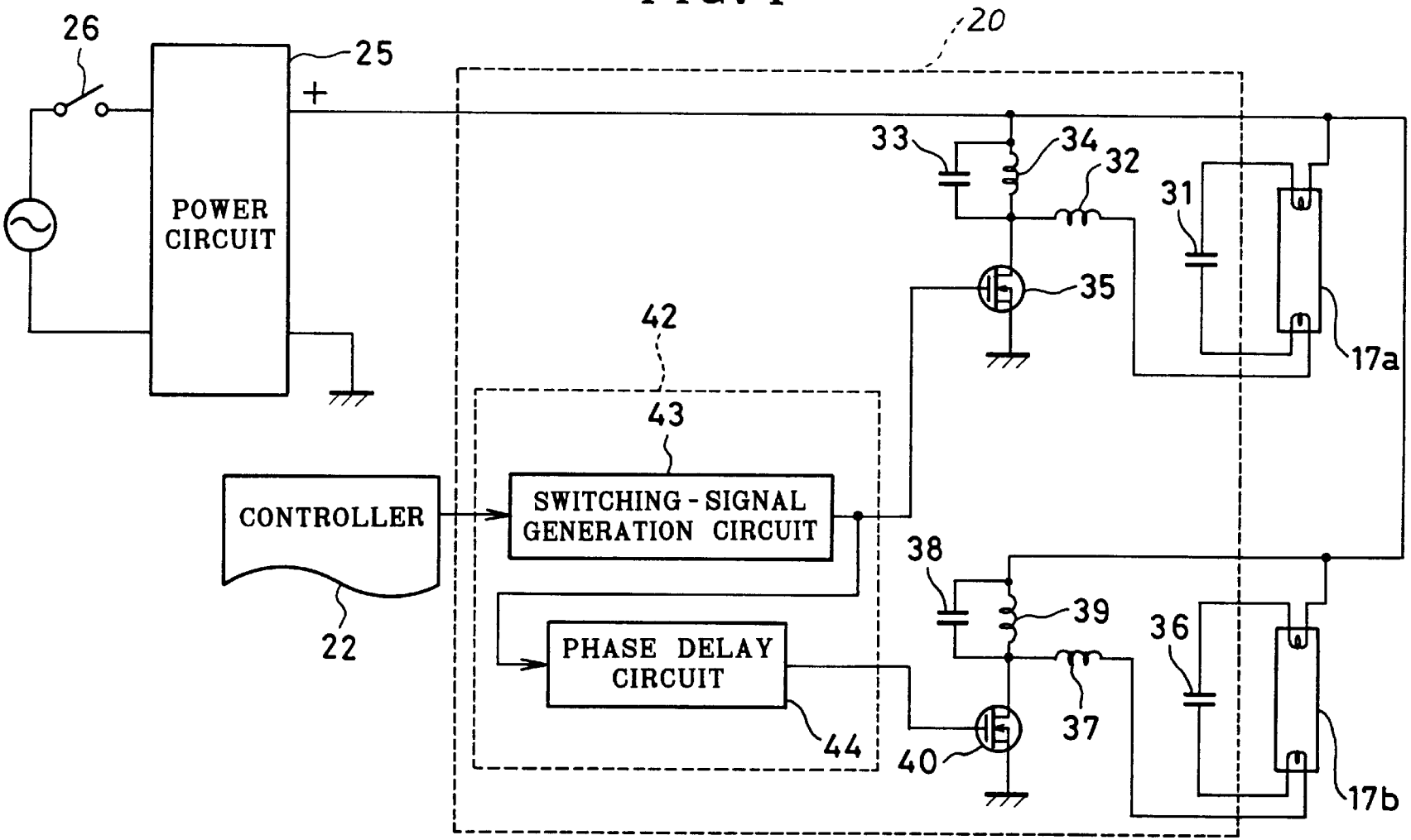
FIG. 1 is a block diagram showing structure of a lamp driver which drives two ultraviolet lamps.

FIG. 1 shows the electrical structure of the yellow lamp driver 20. A power circuit 25 rectifies and smoothes an alternating voltage obtained from a commercial power source in order to output a predetermined DC voltage. A switch 26 is turned on and off in association with a main switch (not shown) of the color thermal printer. The yellow lamp driver 20 being as a light-source controlling device activates the ultraviolet lamps 17*a* and 17*b* in an inverter system by utilizing the DC voltage outputted from the power circuit 25.

Similarly to a circuit of a conventional inverter system, the first ultraviolet lamp 17*a* for yellow is connected to a series resonance circuit constituted of a capacitor 31 and a coil 32. The capacitor 31 is connected to the first ultraviolet lamp 17*a* in parallel, and the coil 32 is connected to the capacitor 31 in series. A plus terminal of the power circuit 25 is connected to both of a drain of a first switching transistor 35 and one end of the coil 32 via a parallel circuit of a capacitor 33 and a coil 34. The series resonance circuit, the parallel circuit, and the first switching transistor 35 constitute the light-source driving device for energizing the light source in response to an emission signal.

Similarly to the first ultraviolet lamp 17*a*, the second ultraviolet lamp 17*b* for yellow is connected to a series resonance circuit constituted of a capacitor 36 and a coil 37. Further, a second switching transistor 40 and a parallel circuit comprising a capacitor 38 and a coil 39 are connected.

With respect to the respective switching transistors 35 and 40, a MOS-type FET is used. The first and second switching transistors 35 and 40 are turned on when a switching signal inputted to its gate is high, and are turned off when the switching signal is low. In this embodiment, the switching signal is the emission signal.

A signal output section 42 for outputting the switching signal, or the emission signal, comprises a switching-signal generation circuit 43 and a phase delay circuit 44. The switching-signal generation circuit 43 generates the switching signal whose signal level is repeatedly changed to high and low by turns under the control of the controller 22. The switching-signal generation circuit 43 selectively outputs a pre-heat switching signal for preheating the filament, and an emission switching signal for repeatedly energizing the yellow ultraviolet lamp. For example, the pre-heat switching signal has a frequency of 70–80 kHz, and the flash switching signal has a frequency of 40–50 kHz.

The switching signal from the generation circuit 43 is sent to both of the first switching transistor 35 and the phase delay circuit 44. The phase delay circuit 44 delays a phase of the inputted switching signal by a predetermined cycle, and sends it to the second switching transistor 40. Thus, the switching signal inputted to the second switching transistor 40 has a phase shifted relative to the switching signal inputted to the first switching transistor 35.

Upon this, the first and second switching transistors 35 and 40 are turned on and off so as to be shifted. Thus, the ultraviolet lamps 17*a* and 17*b* are repeatedly energized such that luminous phases thereof are shifted. In other words, by shifting the luminous phases of the ultraviolet lamps 17*a* and 17*b*, it is caused to shift phases of the alternating currents flowing from the power circuit 25 to the ultraviolet lamps 17*a* and 17*b*. Peak phases of the currents flowing in the ultraviolet lamps 17*a* and 17*b* are shifted so that a peak value of the total of the respective currents is lowered in comparison with a case in that the ultraviolet lamps 17*a* and 17*b* are energized at the same time. In virtue of this, it becomes possible to use the small-sized power circuit 25 having a small rated power. Further, by shifting peaks and troughs of the currents flowing in the ultraviolet lamps 17*a* and 17*b*, a range of the total of the respective currents is narrowed. Owing to this, an output voltage of the power circuit 25 is controlled so as to reduce its fluctuation.

Figure 3:
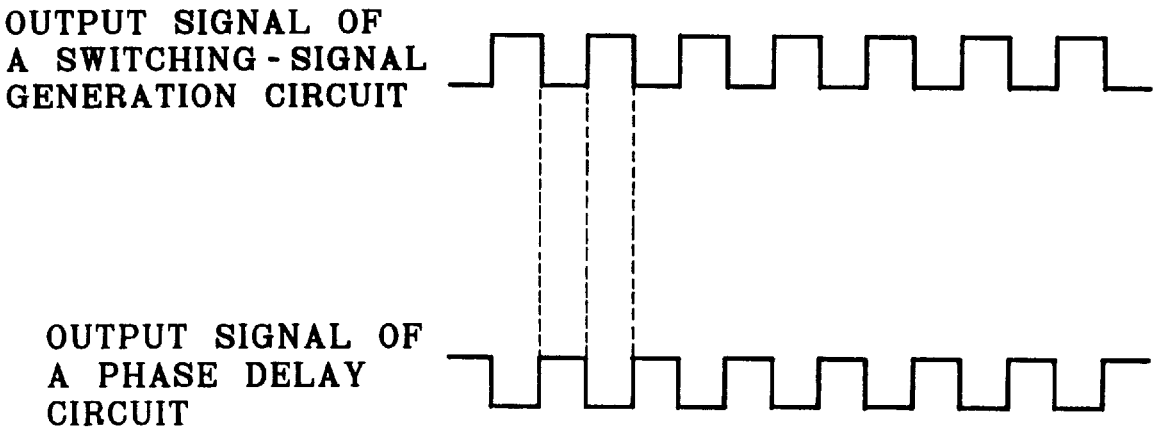
FIG. 3 is a waveform chart showing two kinds of switching signals which are outputted from a signal-output port and have shifted phases as each other.

In this embodiment, as shown in FIG. 3 for example, the switching-signal generation circuit 43 outputs the switching signal whose duty factor (ratio of high to one cycle) is 50%. Moreover, the phase delay circuit 44 outputs the switching signal whose phase is delayed by 180° (half cycle) in comparison with the switching signal outputted from the switching-signal generation circuit 43. Accordingly, when the current flows in one of the ultraviolet lamps 17*a* and 17*b*, the current does not flow in the other thereof. Thus, although the two ultraviolet lamps 17*a* and 17*b* are repeatedly energized at the same time, the peak current is adapted to be identical with that of a single ultraviolet lamp.

The magenta lamp driver 21 shares the power circuit 25 with the yellow lamp driver 20. Structure of the magenta lamp driver 21 is similar to the yellow lamp driver 20 so that a drawing and description thereof are omitted.

Next, an operation of the above-mentioned structure is described. When printing is performed, three-color image data introduced from a scanner, a video camera or the like are written in the image memory 23. After that, upon manipulation of a print key, the controller 22 actuates a paper feeding device to forward the recording paper 10 from a paper cassette (not shown) toward the downstream side. While the recording paper 10 is fed, the thermal head 12 is set at the evacuation position separated from the platen roller 11. The recording paper 10 passes through a space between the thermal head 12 and the platen roller 11, and is nipped by the conveyor roller pair 15.

After the recording paper 10 has been nipped with the conveyor roller pair 15, the pulse motor 16 is driven to convey the recording paper 10 toward the downstream side. During this conveyance, when a leading edge of the recording paper 10 is detected by a positional sensor which is not shown, a yellow printing step is started. First of all, the thermal head 12 is moved to the printing position where the heating element array 12*a* is pressed against the recording paper 10.

Successively, the controller 22 instructs the switching-signal generation circuit 43 of the yellow lamp driver 20 to output the pre-heat switching signal. Upon this instruction, the switching-signal generation circuit 43 sends the pre-heat switching signal to the first switching transistor 35. A level of the pre-heat switching signal changes to "H" (High) and "L" (Low) by turns in a frequency of 70 kHz, for example. Moreover, the pre-heat switching signal is also sent to the second switching transistor 40 via the phase delay circuit 44.

Since the pre-heat switching signal changes to "H" and "L", the first switching transistor 35 is repeatedly turned on and off in the frequency of 70 kHz. Thus, a preheating current supplied from the power circuit 25 in synchronism with the ON-state of the first switching transistor 35 flows in the respective filaments of the first ultraviolet lamp 17*a*.

On the other hand, with respect to the second switching transistor 40, the pre-heat switching signal inputted thereto has a phase delayed by 180° relative to the one inputted to the first switching transistor 35. The second switching transistor 40 is repeatedly turned on and off so that the preheating current supplied from the power circuit 25 flows in the respective filaments of the second ultraviolet lamp 17*b*. At this time, the second switching transistor 40 is turned on and off such that its phase is shifted by 180° relative to the first switching transistor 34. Thus, the phase of the preheating current flowing in the second ultraviolet lamp 17*b* is shifted by 180° relative to that of the first ultraviolet lamp 17*a*.

As stated above, the ultraviolet lamps 17*a* and 17*b* are preheated by letting the preheating current flow for the predetermined duration. Then, the controller 22 instructs the switching-signal generation circuit 43 to output the emission switching signal. Upon this instruction, the switching-signal generation circuit 43 sends the emission switching signal to the first switching transistor 35. A level of the emission switching signal changes to "H" and "L" by turn in a frequency of 40 kHz, for example. The emission switching signal is also sent to the second switching transistor 40 via the phase delay circuit 44.

In response to the emission switching signal, the first and second switching transistors 35 and 40 are repeatedly turned on and off similarly to the action of the preheating time. On this occasion, owing to an operation of the series resonance circuit and so forth, the ultraviolet lamps 17*a* and 17*b* perform electric discharge between the respective filaments in synchronism with the ON-state of the corresponding switching transistors 35 and 40.

The ultraviolet lamps 17*a* and 17*b* emit the light every electric discharge caused between the respective filaments, and this emission due to the electric discharge is repeated. Of course, regarding the first and second switching transistors 35 and 40, the phases of the ON-OFF states thereof are shifted by 180° with each other. Accordingly, the currents accompanying the electric discharge flow in the respective ultraviolet lamps 17*a* and 17*b* in a state that the phases thereof are shifted by 180°.

After the ultraviolet lamps 17*a* and 17*b* have been in a condition of the repeated emission, the controller 22 reads out the yellow image data of the first line from the image memory 23 and sends it to the head driver 24. The head driver 24 converts the yellow image data to the one-line drive data. Based on this drive data, the corresponding heating element of the heating element array 12*a* is driven to perform bias heating and gradation heating. Each heating element generates the bias thermal energy, and the gradation thermal energy based on the yellow image data to color the yellow thermosensitive coloring layer of the recording paper 10.

When the first line of the yellow image has been recorded, the yellow image data of the second line is read out from the image memory 23 to be sent to the head driver 24. After that, similarly to the above-described sequence, the respective heating elements are driven to record the second line of the yellow image on the recording paper 10. In this way, the third line of the yellow image and succeeding lines thereof are successively recorded one line by one line.

When the portion of the recording paper 10 in which the yellow image has been recorded reaches the yellow fixing unit 17, the yellow ultraviolet rays are applied from the first and second ultraviolet lamps 17*a* and 17*b*. After recording the final line of the yellow image, the recording paper 10 is conveyed toward the downstream side until an end of the recording area passes through the yellow fixing unit 17.

When the end of the recording area has passed through the yellow fixing unit 17, the switching-signal generation circuit 43 stops to output the emission switching signal upon an instruction from the controller 22. Thereby, the ultraviolet lamps 17*a* and 17*b* are turned off. Moreover, the pulse motor 16 is stopped for the present and the thermal head 12 is moved to the evacuation position. After that, the pulse motor 16 is driven in reverse so that the recording paper 10 is conveyed by the conveyor roller pair 15 toward the upstream side of the conveyance passage. In accordance with this conveyance, the leading edge of the recording area reaches the position of the thermal head 12. Then, the conveyor roller pair 15 is stopped to rotate, and the thermal head 12 is moved to the printing position. Further, similarly to the ultraviolet lamps 17*a* and 17*b* for yellow, the ultraviolet lamps 18*a* and 18*b* for magenta are repeatedly energized by the magenta lamp driver 21.

After moving the thermal head 12 to the printing position, the pulse motor 16 is driven forward again so that the recording paper 10 is conveyed by the conveyor roller pair 15 toward the downstream side of the conveyance passage. During this action, the heating element array 12*a* performs the bias heating and the gradation heating for magenta against the recording paper 10 so as to record the magenta image one line by one line. The ultraviolet rays from the ultraviolet lamps 18*a* and 18*b* are applied to the portion of the recording paper 10 in which the magenta image has been recorded so that the magenta thermosensitive coloring layer is optically fixed.

After the end of the recording area has passed through the magenta fixing lamp 18, the recording paper 10 is returned for the present, and then, is conveyed toward the downstream side again. During this conveyance, the heating element array 12*a* records the cyan image one line by one line. The recording paper 10 on which the final line of the cyan image has been recorded is conveyed as it is to be discharged through a paper outlet.

As stated above, the ultraviolet lamps 17*a* and 17*b* are simultaneously activated while the yellow image is recorded, and the ultraviolet lamps 18*a* and 18*b* are simultaneously activated while the magenta image is recorded. In this operation, the corresponding switching transistors 35 and 40 are turned on and off such that the phases thereof are shifted with each other. Thus, it is possible to activate the ultraviolet lamps by the power circuit 25 having a small rated power. Moreover, the change of the current supplied to the fixing unit is kept in a narrow range so that the output voltage of the power circuit 25 is adapted to be changed in a narrow range. For example, even if the power circuit is used for both of the thermal head 12 and the fixing units 17 and 18, an applied voltage to the thermal head 12 may change in a narrow range. Accordingly, it is possible to prevent density unevenness of the recorded image from generating.

Figure 4:
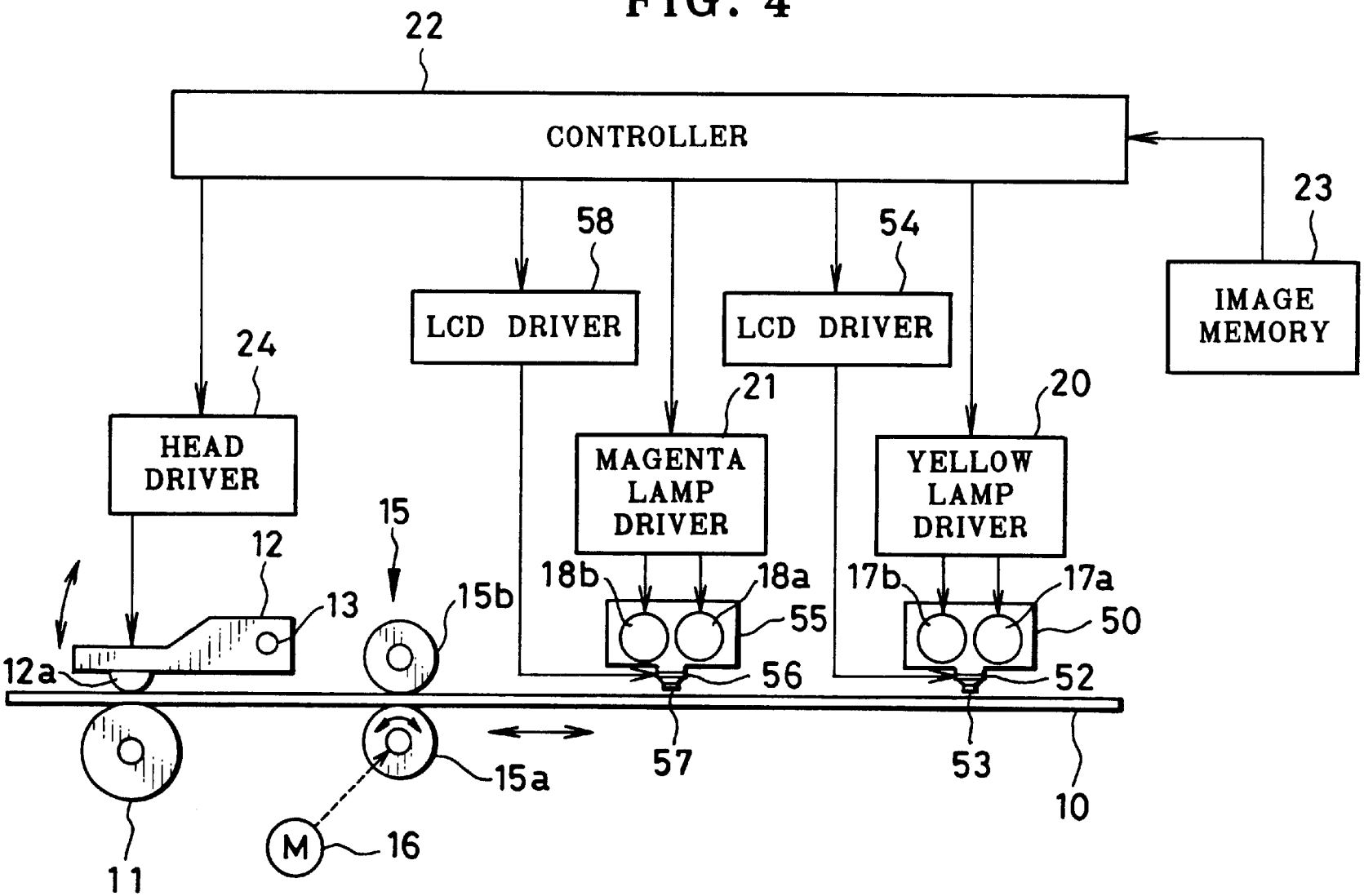
FIG. 4 is a block diagram showing an embodiment in which a latent image is recorded by a ultraviolet lamp.

FIG. 4 shows another embodiment in which the ultraviolet lamps for yellow and magenta are used as light sources for recording latent images of yellow and magenta images on a color thermosensitive recording paper. In this case, a cyan image is recorded by a thermal head, and the yellow and magenta images are colored by thermal energy applied for the purpose of recording the cyan image. By the way, in the following description, constituent members being identical with that of the above embodiment are denoted by the same reference numeral, and its explanation is omitted.

An optical head 50 for yellow has first and second ultraviolet lamps 17*a* and 17*b* for yellow which are built therein. Moreover, a liquid crystal array 52 and a lens array 53 are provided at the bottom of the optical head 50. The liquid crystal array 52 comprises fine liquid crystal segments aligned in a width direction of a color thermosensitive recording paper 10. One of the liquid crystal segments corresponds to one pixel at the time of printing. The liquid crystal array 52 intercepts the ultraviolet rays for yellow and regulates a transmission amount thereof such that the density of each liquid crystal segment is controlled by an LCD driver 54 on the basis of yellow image data. In virtue of this, the yellow thermosensitive coloring layer is fixed, keeping ability for coloring in the density corresponding to the yellow image data. At this time, the yellow latent image is recorded one line by one line. The lens array 53 prevents the ultraviolet rays applied to each pixel from spreading to the other pixel.

Similarly, an optical head 55 has first and second ultraviolet lamps 18*a* and 18*b* built therein. A liquid crystal array 56 and a lens array 57 are provided at the bottom of the optical head 55. Density of each segment of the liquid crystal array 56 is controlled by an LCD driver 58 on the basis of magenta image data so that the ultraviolet rays for magenta are intercepted and a transmission amount thereof is regulated. In such way, the magenta latent image is recorded one line by one line on the recording paper 10.

Each heating element of the thermal head 12 is driven on the basis of cyan image data. Thus, a cyan thermosensitive coloring layer is colored so as to record a cyan image one line by one line. At the same time, the yellow and magenta images having been recorded as the latent images are colored.

In this case, while the recording paper 10 is conveyed from the upstream side toward the downstream side, the ultraviolet rays for yellow, an application amount of which is adjusted by the optical head 50 every pixel, are applied to the recording paper 10 for recording the yellow latent image one line by one line. Moreover, the magenta latent image is recorded one line by one line with the optical head 55. When the portion in which the yellow and magenta latent images have been recorded reaches the thermal head 12, thermal energy for recording the cyan image is applied to the recording paper 10 by the thermal head 12. Thus, the cyan image is colored one line by one line. Further, the thermal energy applied at this time is greater than the maximum one for coloring the yellow and magenta thermosensitive coloring layers so that the yellow and magenta images are colored owing to the coloring ability remaining in the respective layers.

In this embodiment, the four ultraviolet lamps are simultaneously and repeatedly energized. In such case, the yellow lamp driver 20 and the magenta lamp driver 21 may independently and repeatedly energize the respective ultraviolet lamps in a state that phases thereof are shifted similarly to the forgoing embodiment. Further, total of the currents flowing in the ultraviolet lamps may be decreased and the range thereof may be reduced by taking synchronism between the lamp drivers, and by shifting the phases of the switching signals supplied to the switching transistors every 90°. Furthermore, the four ultraviolet lamps may be grouped two by two such that phases thereof coincide in each group and are shifted by 180° as for the respective groups.

In the above embodiments, the ultraviolet lamps are provided by two or four. However, a number of the ultraviolet lamps may be three or more than four. For example, when the number of the light sources is three, the switching signals supplied to the three switching transistors may be mutually shifted by 120°. Moreover, in the above embodiments, the switching signal for turning on and off the switching transistor, that is the pulse signal, is used as the emission signal. However, a signal having an any form may be used in accordance with a driving system of the light source. For example, phases of sine signals in which currents and voltages change along a sine curve may be shifted.

In the above embodiments, the ultraviolet lamp is used as the light source to record and fix the image on the recording paper. However, the present invention is not exclusive to this, and is applicable to a normal fluorescent lamp and a surface luminophor which emits the light due to plasma emission. The present invention is also applicable to a light source of a printer in which an image is exposed and recorded on a photographic paper, and to a light source of a scanner, a copying machine or the like. Further, the present invention is applicable to a case in that a plurality of flash discharge tubes are repeatedly energized. In this case, charge timing of a capacitor provided for each discharge tube is shifted by changing a phase of its trigger signal for flash emission. In virtue of this, the total of charging currents may be reduced.

As described above, in the light-source controlling device according to the present invention, the emission signals whose phases are sifted with each other are outputted to the light-source driving element s which are provided for each of the light sources. Therefore, the emission phases of the respective light sources are shifted so that the peaks and troughs of the currents flowing in the respective light sources are shifted. Thus, it becomes possible to use a power source having a small rated power. At the same time, a voltage outputted from a power circuit may be kept in a narrow range.

Although the present invention has been fully described by way of the preferred embodiments thereof with reference to the accompanying drawings, various changes and modifications will be apparent to those having skill in this field. Therefore, unless otherwise these changes and modifications depart from the scope of the present invention, they should be construed as included therein.

What is claimed is:

1. A device for controlling light sources in which each light source emits a light for any purpose of optical fixation, illumination and optical recording, said device comprising:

light-source driving elements provided for the respective light sources, said light source being driven and emitting the light in accordance with activation of the corresponding light-source driving element; and a signal output circuit connected to said light-source driving elements and for outputting signals by which said light-source driving elements are repeatedly activated, said signals outputted from said signal output circuit having shifted phases with each other;

wherein said light sources are connected to a first light-source driving element and a second light-source driving element;

wherein said signal output circuit includes a signal generation circuit for generating a switching signal by which the light-source driving elements are activated, and a phase delay circuit connected to the signal generation circuit for delaying a phase of said signal;

wherein said signal of said signal generation circuit is directly outputted to said first light-source driving element, and is outputted to said second light-source driving element via said phase delay circuit.

2. A device for controlling light sources according to claim 1, wherein said light sources are provided by two, one of which is connected to the first light-source driving element and the other of which is connected to the second light-source driving element.

3. A device for controlling light sources according to claim 2, wherein said switching signal is a pulse signal.

4. A device for controlling light sources according to claim 1, wherein said phase delay circuit shifts the phase by 180°.

5. A device for controlling light sources according to claim 4, wherein said light-source driving element is a switching transistor.

6. A device for controlling light sources according to claim 5, wherein said switching transistor is a MOS-type FET.

7. A device for controlling light sources according to claim 1, wherein said light source is one of an ultraviolet lamp, a fluorescent lamp, and a surface luminophor emitting the light by plasma emission.

* * * * *